United States Patent [19]

Greenwood

[11] Patent Number: 4,558,915

[45] Date of Patent: Dec. 17, 1985

[54] ELECTRICAL CONNECTOR

[75] Inventor: William S. Greenwood, Nutley, N.J.

[73] Assignee: Thomas & Betts Corporation, Raritan, N.J.

[21] Appl. No.: 123,490

[22] Filed: Feb. 21, 1980

[51] Int. Cl.[4] ..... H01R 11/20

[52] U.S. Cl. ..... 339/97 C

[58] Field of Search ..... 339/97 C, 98 R, 99, 339/17 F, 176 MF

[56] References Cited

U.S. PATENT DOCUMENTS

| | | | |
|---|---|---|---|
| 3,197,831 | 8/1965 | Martin et al. | 24/16 |
| 3,549,786 | 12/1970 | Kuo | 174/84 |
| 3,621,117 | 11/1971 | Antas et al. | 339/97 C X |
| 3,636,592 | 1/1972 | Beach | 24/23 W |
| 3,728,473 | 4/1973 | Kuo | 174/84 C |
| 3,812,448 | 5/1974 | Haitmanek | 339/97 C |
| 3,880,488 | 4/1975 | Collier et al. | 339/97 C |
| 3,960,430 | 6/1976 | Bunnell et al. | 339/97 C |
| 3,989,339 | 11/1976 | Haitmanek | 339/97 C |
| 3,997,233 | 12/1976 | Evans | 339/97 C |
| 4,065,199 | 12/1977 | Andre et al. | 339/97 C X |
| 4,082,402 | 4/1978 | Kinkaid et al. | 339/97 C |

*Primary Examiner*—Eugene F. Desmond

*Attorney, Agent, or Firm*—Robert M. Rodrick; Salvatore J. Abbruzzese

[57] ABSTRACT

A plurality of projections each including a pair of outwardly extending teeth are provided on first and second arm portions of an elongate plate member bendable about an electrical conductor. The projections on each arm portion preferably extend transversely across the plate member and are substantially parallel to each other and orthogonal to the bending line. The projections on one arm portion are formed to be transversely offset with the projections on the other arm portion such that upon bending said member so that the teeth contact the conductor, a tooth edge of each of the projections on one arm portion lies between the teeth edges of the projections on the facing associated projections. Piercing of electrical insulation and conductors of flat cable conductors for good mechanical and electrical contact and desirably thin connections is facilitated by such a connector.

17 Claims, 6 Drawing Figures

ELECTRICAL CONNECTOR

BACKGROUND OF THE INVENTION

1. Field of the Invention

This invention relates to an electrical connector and more particularly to a cable connector for making electrical contact with conductors of flat conductor cable.

2. Description of the Prior Art

Flat multiconductor power cable, in which a plurality of flat electric conductors are contained in a thin film of electric insulation, is described, for example, in U.S. Pat. No. 4,283,593 issued on Aug. 11, 1981, entitled "Multiconductor Cable" and assigned to the same assignee as is the present invention. In a system in which a plurality of such cables are adapted to be placed on the floor and to extend in several directions, it is necessary to electrically connect the conductors of one flat multiconductor cable with those of another flat multiconductor cable. It is desirable, particularly in undercarpet systems, that the connecting device be relatively easy to install, have a minimum thickness to prevent unsightly carpet bulges and provide a reliable mechanical and electrical contact under continuous application of various loads.

One known connecting device for use in connecting flat conductor cables is described in U.S. Patent entitled "Self-Locking Clamp Member", now U.S. Pat. No. 4,248,493, issued Feb. 3, 1981, and assigned to the same assignee as is the present invention. In this application, the clamp member to be used with flat conductor cable has first and second bendable arm portions that are bent to overlie one another and to receive the flat conductor cables therebetween. The two opposing arm portion surfaces are each provided with a plurality of insulation piercing teeth which serve to pierce through the insulation surrounding a conductor to make electrical contact therewith. A locking mechanism is provided on the connector for holding the connector in a fixed contact position with the cable conductor.

Due in particular to the teeth construction, repetitive or continuous direct loads on this clamp member may cuase the teeth in contact with the conductor to loosen, thereby reducing the effectiveness and reliability of the connection. Thus, of use as an undercarpet connector in particularly heavy duty environments, the clamp member is preferably supported by resilient components so as to minimize or prevent direct application of loads on the connector.

SUMMARY OF THE INVENTION

It is an object of the present invention to provide a connector for use in undercarpet installations that assures reliable connections without need for additional resilient supportive elements.

In accordance with the present invention, there is provided an electrical connector for making electrical contact to a conductor and which is particularly useful in joining together the conductors of two separate flat conductor cables.

The connector comprises an elongate bendable plate member for bending along a bending line, the member including a first arm portion and a second arm portion separated from one another by the bending line. A projection extends outwardly from and along the surface of each arm portion, each projection having a pair of teeth that extend along opposite sidewall surfaces of the projections. The teeth on the projections are substantially parallel and each tooth has a relatively sharp edge at the extreme distal location from the surface of each arm portion. The projections are arranged on the arm portions such that upon bending the member about the bending line, the projections are positioned in a facing relation so that the teeth edges contact conductors disposed therebetween. At this conductor contact position, facing projections are offset with respect to each other such that a tooth edge of one projection lies facingly between the teeth edges of the other projection.

In a preferred embodiment, the projections are arranged such that upon bending, teeth edges pierce the conductors. In a further preferred aspect, teeth edges of facing projections that pierce the conductors pass through a common plane intermediate the arm portions of the member in its bent position. In another aspect, the connector includes means for locking the arm portions in a fixed bent position so that the teeth are held in contact with the conductors.

In a preferred embodiment, in which the connector is adapted for use in providing electrical connection with a flat conductor cable of the type having enclosing electrical insulation thereabout, a plurality of projections with a pair of teeth are provided on each of the sectors of an elongate plate member that is bent about its bending axis, the bending axis being substantially orthogonal to the longitudinal axis of the plate member. In the bent position, the sectors are arranged in spaced relation adjacent opposite surfaces of the flat conductors whereby the teeth on facing projections pierce the insulations and contact the conductors. In the conductor contacting position, a tooth edge of each of the projections on one sector lies facingly between the teeth edges of an associated projection on the other sector. The projections may be arranged on the sectors either parallel to or orthogonal with the bending axis of the plate member. In the former arrangement, facing projections are longitudinally offset with respect to each other. In the latter arrangement, facing projections are offset with respect to each other transversely of the elongate plate member.

In a preferred embodiment in which the connector is adapted for use in making electrical connection with at least two flat conductor cables each having enclosing electrical insulation thereabout, a plurality of projections having a pair of teeth are arranged on two sectors of a bendable elongate plate member extending orthogonal to the bending axis and transversely across the plate member such that upon bending, each sector is positioned adjacent a respective flat conductor cable. The projections are arranged such that upon bending, oppositely facing teeth pierce the insulation and conductor of the respectively adjacent conductor cables, the facing teeth lying in offset relation to each other transversely of the elongate plate member whereby a tooth edge of each of the projections on one sector lies between the teeth edges of a facing projection on the other sector.

DETAILED DESCRIPTION OF THE PREFERRED EMBODIMENT

Figure 1:
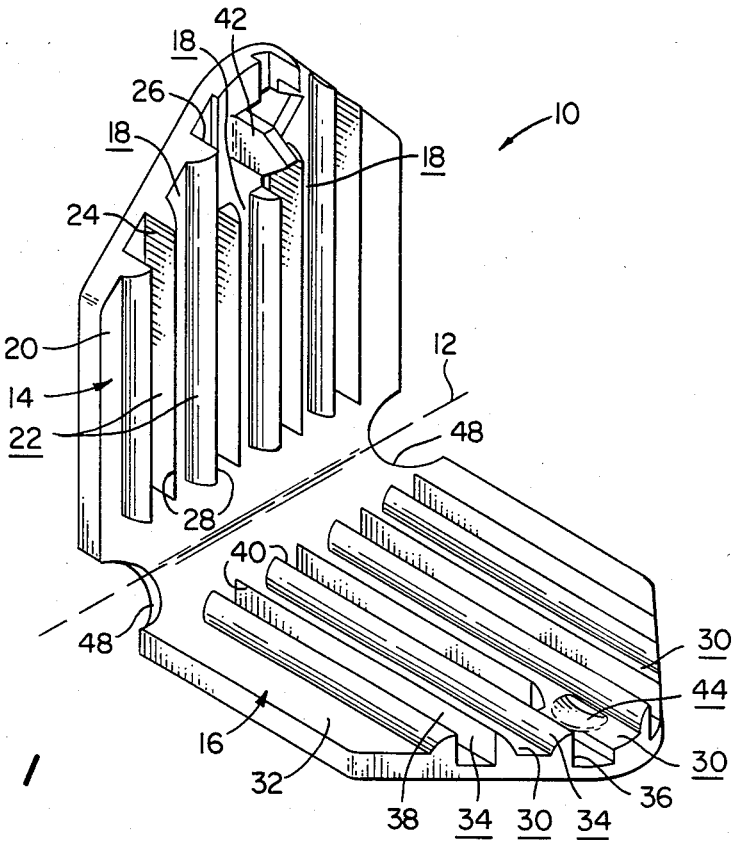
FIG. 1 is a perspective view of a preferred embodiment of an electrical connector in accordance with the present invention.

Referring to the drawing, there is shown in FIG. 1 an electrical connector 10 in accordance with the present invention which is particularly useful for making electrical contact with the conductors of a flat cable. The connector 10 includes a bendable member that is adapted to bend along a bending line 12 to define first and second arm portions 14 and 16. In the preferred embodiment shown, the entire connector 10 is metallic so as to be suitable for conducting electricity when the connector 10 is attached to and makes electrical contact with the conductor of a flat conductor cable. Although the shape of the arm portions 14, 16 are shown as being pentagonal it should be appreciated that other shapes may also be used and that arm portions 14 and 16 need not have the same shape. The bendable member is shown as being elongate, its longitudinal axis being orthogonal to its bending axis or line 12.

The arm portion 14 is provided with a plurality of projections 18 that extend outwardly from and transversely across surface 20 of the arm portion 14. Each projection 18 has a pair of teeth 22 extending longitudinally along opposite sidewall surfaces 24, 26 of each projection 18. The teeth 22 on each of the projections are formed to extend substantially parallel to each other and to have relatively sharp edges 28 at the extreme distal location from the surface 20. The arm portion 16 is similarly provided with a plurality of projections 30 that extend outwardly from and transversely across surface 32 of the arm portion 16. Each projection 30 has a pair of teeth 34 extending longitudinally along opposite sidewall surfaces 36, 38 of each projection 30. The teeth 34 are formed to be substantially parallel with each other and with the teeth 22 on first arm portion 14. The teeth 34 are also formed to have relatively sharp edges 40 at the extreme distal location from the surface 32.

In the preferred embodiment, the projections 18, 30 on each of the respective arm portions 14, 16 extend along surfaces 20, 32 substantially orthogonal to the bending line 12. The projections 18, 30 are further formed on the respective surfaces 20, 32 such that the teeth 22, 34 are transversely offset a distance from each other as will be described more fully with respect to FIG. 4.

The first arm portion 14 is preferably provided with a bendable tab 42 which extends away from the surface 20 as shown in FIG. 1. In the embodiment shown, the tab 42 has been punched or stamped out from the first arm portion 14. The second arm portion 16 is provided with an opening 44 therethrough which is arranged with respect to the bending line 12 so as to be adapted to receive the tab 42 when the bendable member 10 is bent along the bending line 12 to move the first and second arm portions towards one another. On the opposite surface of the arm portion 16, there is provided a hood 46 (FIG. 3) for bending the tab 42 when the tab 42 enters and passes through the opening 44. The tab 42, opening 44 and hood 46 serve as a locking means for holding the arm portions 14 and 16 in a fixed position after the bendable member is bent to its desired position as will be described. Such a locking device is more fully described in U.S. Pat. No. 4,248,493, issued on Feb. 3, 1981, entitled "Self-Locking Clamp Member" and herein incorporated by reference. To facilitate accurate bending of the first and second arm portions 14, 16 about the bending line 12, cutouts 48 are provided to reduce the cross-sectional area along the line 12. Although the tab 42 as described is preferred to hold the arm portions 14, 16 in a fixed position, it should be understood that other suitable locking devices may also be used.

Figure 2:
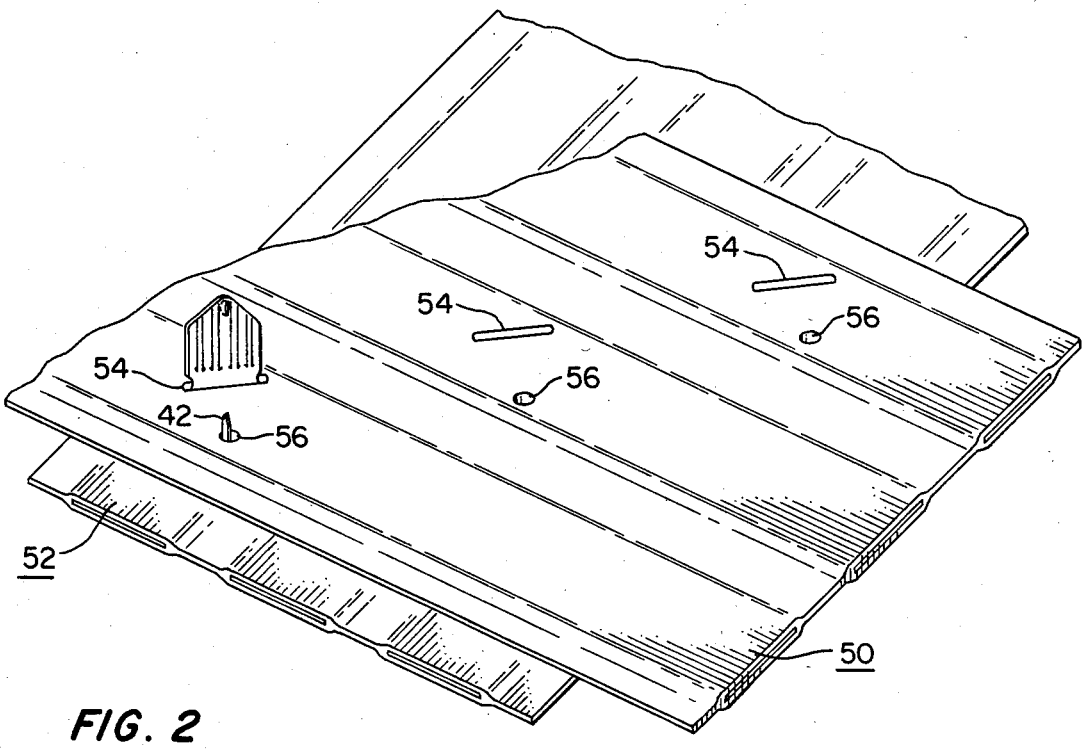
FIG. 2 is a perspective view of two overlapping flat conductor cables with the connector of FIG. 1 shown at an intermediate stage of assembly for connecting conductors of the two cables.

The electrical connector 10 of the present invention is particularly useful in interconnecting the electrical conductors of two overlapping flat conductor cables 50 and 52, as shown in FIG. 2, flat cables 50 and 52 being of the conventional type having a plurality of conductors enclosed by electrical insulation thereabout. As illustrated, a plurality of slots 54 and apertures 56 are perforated through the cables 50 and 52 at the desired locations for interconnection. The connector 10 as described hereinabove is inserted through the aligned slots 54 with the locking tab 42 protruding through aligned apertures 56.

Figure 3:
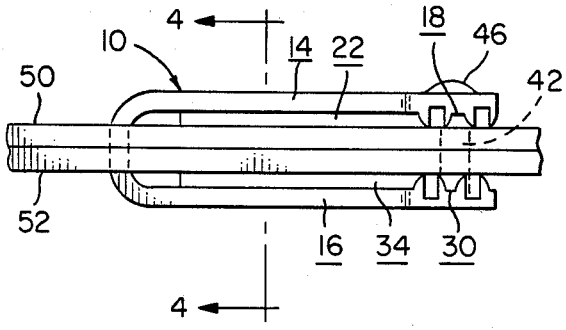
FIG. 3 is side elevation view of the conductor cables of FIG. 2 showing the connector closed to a position just prior to penetration of connector teeth into the respective cables.

As depicted in FIG. 3, the connector 10 is bent about its bending line to position the first arm portion 14 adjacent conductor cable 50 and to position second arm portion 16 adjacent the other conductor cable 52. As shown in FIG. 3 and in more detail in FIG. 4, the teeth 22, 34 on the respective arm portions 14, 16 are just contacting the outer surface of each of the cables 50, 52, the connector 10 being not fully clamped to its final position. In this position, the projections 18, 30 have been positioned to oppositely face each other, the surfaces 20 and 32 of the respective arm portions 14, 16 being substantially parallel and oppositely spaced from each other.

Figure 4:
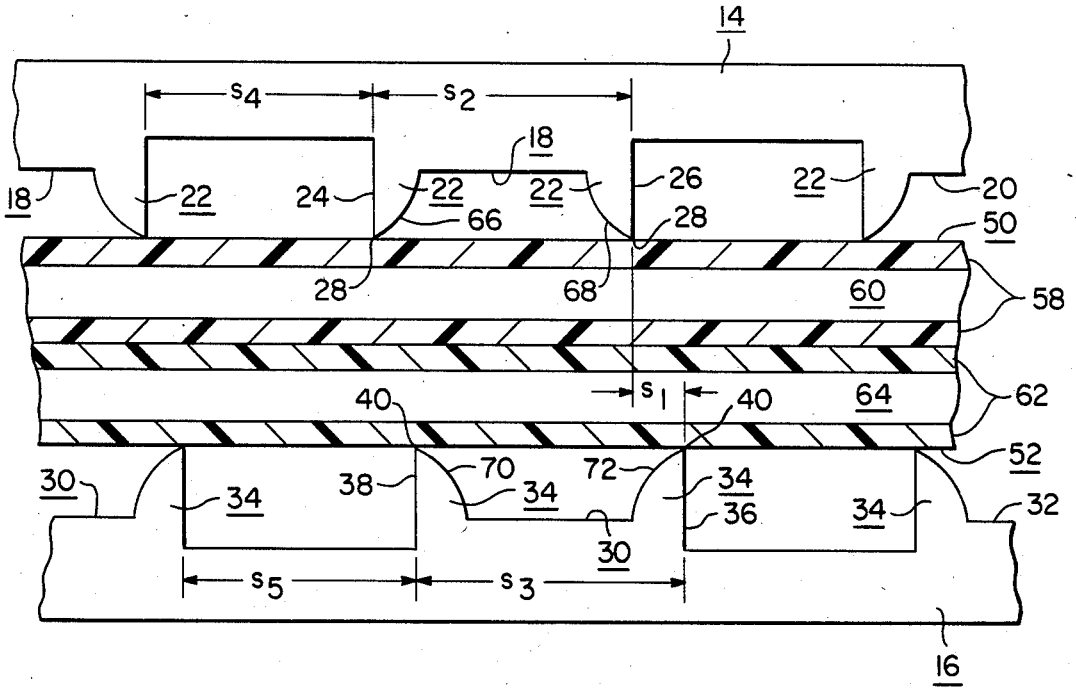
FIG. 4 is an enlarged partially sectioned view of the connector and cables as seen along viewing lines 4—4 of FIG. 3.

In FIG. 4, the cable 50 is shown as including a layer 58 of electrical insulation surrounding an electrical conductor 60 and the cable 52 as including a layer 62 of electrical insulation around an electrical conductor 64. Also shown is the preferred teeth configuration of the respective projections 18 and 30. In the embodiment shown, the opposite sidewall surfaces 24, 26, and 36, 38 of projections 18 and 30 are substantially planar, each surface forming one of the sides of the teeth 22, 34, respectively. The other side of each of the teeth 22 is formed by a curved surface 66 and 68 respectively that converges with sidewalls 24 and 26 to form the sharp edge 28 along the teeth 22. Similarly, the other side of each of the teeth 34 is formd by a curved surface 70 and 72 that converges with sidewalls 36 and 38 respectively to form the sharp edges 40 along the teeth 34. Although the tooth configuration illustrated in FIG. 4 is preferred, it should be understood that other tooth configurations for the projections are useful in the contemplated scope of the invention. Such other configurations are shown and described, for example, in FIGS. 8 and 9 of U.S. Haitmanek Pat. No. 3,812,448 issued on May 21, 1974 and herein incorporated by reference.

Referring again to FIG. 4, the transverse offset of the projections 18, 30 on the arm portions 14, 16, now in oppositely facing relation, can be seen. In the position shown, one of the teeth edges 28 on each projection 18 lies facingly between the teeth edges 40 of an opposing associated projection 30. As shown in FIG. 4, the transverse offset is characterized by a distance, $s_1$, between the opposing teeth edges 28 and 40. In the preferred embodiment, the projections 18, 30 are formed such that the spacing, $s_2$, between surfaces 24 and 26 is approximately equal to the spacing, $s_3$, between surfaces 36 and 38. Also, the spacing, $s_4$, between the projections 18 is preferably equal to the spacing, $s_5$, between the projections 30. Further it is preferred as will be described, that the tooth edge 28 lying between the teeth edges 40 be more proximate one tooth edge 40, the spacing, $s_1$, being on the order of the width of one tooth 22.

Figure 5:
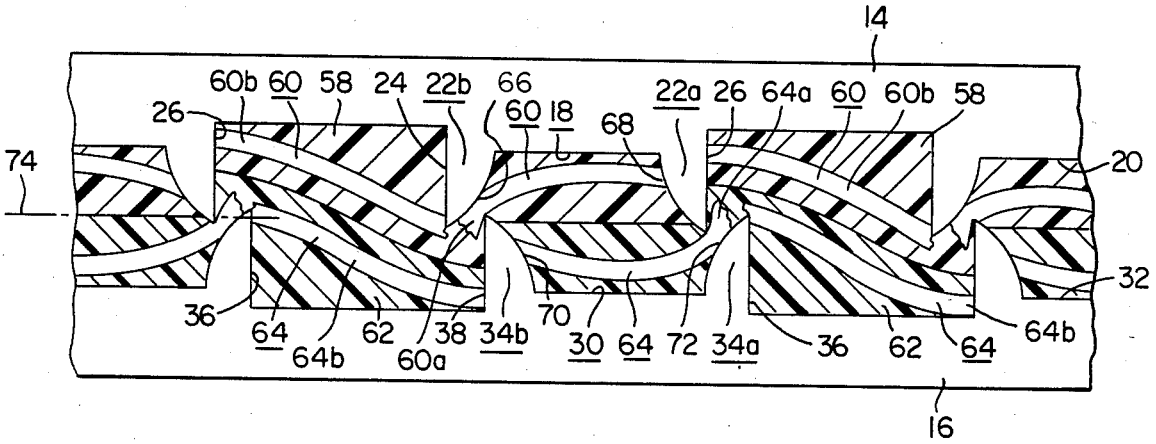
FIG. 5 is a successor view of FIG. 4 wherein the connector has been closed upon the cables to its final position.

Referring now to FIG. 5, the first and second arm portions 14, 16 as positioned in FIG. 4 are further clamped or crimped by suitable means (not shown) to a final closed position to establish contact with conductors 60 and 64. In the preferred form of the interconnection between the two flat conductor cables 50 and 52, it is contemplated that teeth 22 and teeth 34 will pierce the respective insulation layers 58 and 62 and the respective electrical conductors 60 and 64. The transverse offset of the projections is provided to permit the sharp edges 28, 40 of opposing teeth 22, 34 to pass through a common plane, intermediate the two facing arm portions 14, 16, the common plane being designated by numeral 74 in FIG. 5. By forming the projections to have a spacing, $s_1$, at least as wide as the tooth width with equally spaced teeth and projections, teeth 22 and 34 can possible seat on the opposite surfaces 32 and 20, thereby permitting a minimum thickness of the connector 10. In the embodiment shown and described, it is preferred that the teeth 22, 34 be formed such that a planar tooth surface such as surface 26 of the tooth 22 positioned between the teeth 34 be more proximate a curved tooth surface such as surface 72 of one of the teeth 34. This tooth arrangement is desirable to minimize scissor-type cutting action that could occur should opposed planar surfaces such a 24 and 36 be relatively close together, in particular where the connector 10 is clamped to have the teeth edges 28, 40 pass through the common plane 74.

In the embodiment illustrated in FIG. 5, it can be seen that in the final clamped position one of the teeth on the projection 18 for example, tooth 22*a*, pierces the insulation 58 and the conductor 60 of the first cable 50 and pierces the insulation 62 and contacts the conductor 64 of the second cable 52. The other tooth 22*b* on projection 18 pierces the insulation 58 and contacts the conductor 60 that is severed, as will be described. On the opposing associated projection 30, one of the teeth, for example, tooth 34*b* that is more proximate facing tooth 22*b*, pierces the insulation 62 and conductor 64 of the second cable 52 and pierces the insulation 58 and contacts the conductor 60 of the first cable 50. The other tooth 34*a* on projection 30 pierces the insulation 62 and contacts the conductor 64.

While at every tooth edge a conductor is severed, it is believed that such severance is not due at each tooth to pure shear. For example, it is believed that with respect to conductor 60, that tooth 22*b* during crimping will extrude the conductor 60 to some degree causing the conductor to curve and that the interaction of opposing tooth 34*b* will then cause a rupture of the conductor 60 due to a combination of shear and tensile forces. At this interface between teeth 22*b* and 34*b* it is also believed that a portion 60*a* of the ruptured conductor is wedged thereby establishing good mechanical contact between opposing teeth and to conductor 60. Similarly, it is believed that a portion 64*a* is wedged between the interface of teeth 22*a* and 34*a* for good contact with conductor 64. It is also believed that between projections 18 a portion 60*b* of the perforated conductor 60 is wedged between planar surfaces 24 and 26. Also, a portion 64*a* of the perforated conductor 64 is belived to be wedged between the planar surfaces 36 and 38 of the spaced projections 30. Such wedged portions 60*b* and 64*b* establish further contact between conductors 60 and 64 through the bent arm portions 14 and 16 of metallic connector 10.

Figure 6:
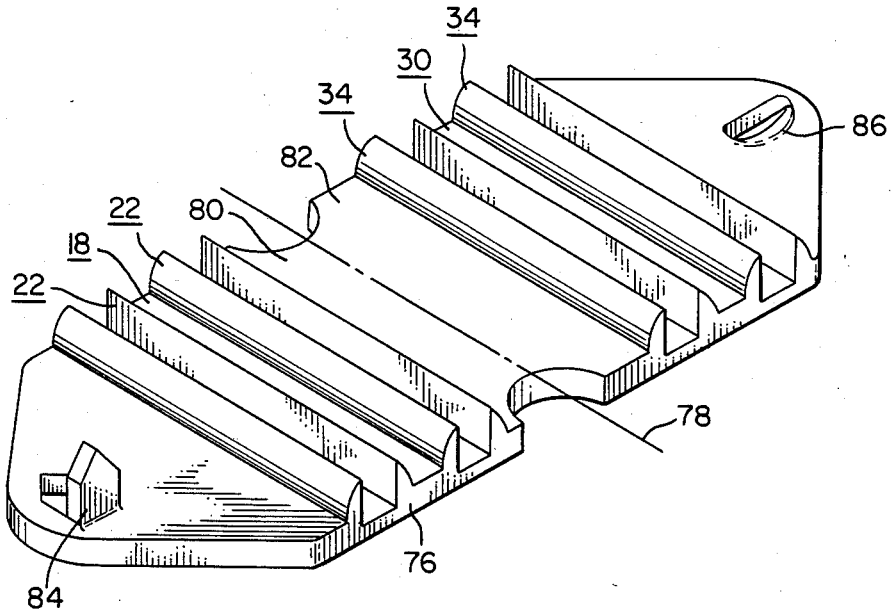
FIG. 6 is a perspective view of another embodiment of the connector of the present invention shown prior to bending thereof.

Although the preferred embodiment of the connector 10 has been described herein as including a bendable member having a plurality of projections 18 and 30 formed on first and second arm portions 14 substantially orthogonal to the bending line 12, it should be appreciated that other connector configurations can also be utilized. For example, in FIG. 6, the connector may comprise an elongate plate member 76 that is bendable about a bending axis 78 that is orthogonal to the longitudinal axis of the plate member 76. The bending axis 78 divides the member 76 into first and second sectors 80, 82 that are adapted to be bendably positioned adjacent first and second flat conductor cables, respectively. A plurality of projections 18, each having a pair of teeth 22, are formed on first sector 80 and a plurality of projections 30, each having a pair of teeth 34, are formed on second sector 82. The projections 18, 30 on the respective sectors 80, 82 are offset with respect to each other longitudinally along the plate member to provide the desirable conductor connection as described hereinabove. It should be noted with respect to this configuration that due to the nonuniform thickness of the plate member in the bending plane, proper bending of the connector may be provided by suitable bending tools. Also, a locking tab 84 and closing means 86 including an opening and tab bending hood (not shown) may also be provided.

Although the preferred embodiment of the connector 10 has been described herein for making an electrical interconnection between conductors of two overlapping flat conductor cables wherein the electrical insulation and the conductors are preferably pierced by the teeth of the offset projections, it should be appreciated that the use is not so limitied. Such a connector may also be utilized within the scope of the invention to make an interconnection wherein the teeth penetrate but do not pierce the conductor. The present connector may further be utilized as a termination making electrical contact with a single conductor. Furthermore, the connections or interconnections made by the connector may be made to conductors with or without electrical insulation.

Thus, it should now be appreciated that an electrical connector of the present invention may be provided in two configurations wherein a projection having a pair of teeth extending outwardly from each surface of two arm portions of the bendable elongate member may be either orthogonal with or parallel to the bending axis. In both arrangements all the teeth are substantially parallel. On the former construction, the projection on one arm portion has a lateral extent in the bendable member that is longitudinally aligned with a lateral extent of the projection on the other arm portion so that the succession of teeth laterally across the bendable member is one tooth on the first projection, then one tooth on the second projection followed by the other tooth on the first projection and then the other tooth on the second projection. In the latter construction, each of the projections has a longitudinal extent spaced differently from and substantially parallel to the bending line so that the succession of teeth in increasing distance from the bending line longitudinally along the bendable member is one tooth on the first projection, then one tooth on the second projection, followed by the other tooth on the first projection and then the other tooth on the second projection.

Various changes to the foregoing, specifically disclosed embodiments and practices will be evident to those skilled in the art. Accordingly, the foregoing preferred embodiments are intended in an illustrative and not in a limiting sense. The true spirit and scope of the invention is set forth in the following claims.

What is claimed is:

1. An electrical connector for making electrical contact to a conductor, comprising:

a bendable member for bending along a bending line, said member including a first arm portion and a second arm portion separated from one another by said bending line; and a pair of teeth extending outwardly from and along a surface of each arm portion, each pair of teeth being spaced by a slot extending within the respective surfaces of said arm portions, the opposing sidewalls of said slot defining a planar surface of each said spaced teeth, each tooth having a nonplanar surface converging with a planar surface to define a sharp edge thereat, said slots in the respective arm surfaces being offset relative to each other such that in the bent configuration one of said teeth on each arm portion lies facingly between the teeth on the other arm portion with the nonplanar surface of such one tooth being facingly more proximate a planar suface of one of the opposing teeth on the other arm portion.

2. An electrical connector according to claim 1, further including means for locking said arm portions in a fixed position relative to each other.

3. An electrical connector according to claim 1, wherein the spacing between the pairs of teeth on each of said arm as defined by said slots is approximately equal.

4. An electrical connector according to claim 1, wherein teeth edges at the distal ends of said teeth are arranged to pass through a common plane intermediate the arm portions of said bendable member in its bent position.

5. An electrical connector according to claim 1 wherein a plurality of such pairs of teeth are provided on a surface of each such arm portions, teeth edges of such pairs being substantially parallel to each other.

6. An electrical connector according to claim 5, wherein the spacing between said pairs of teeth is approximately equal.

7. An electrical connector according to claim 5, wherein said bendable member is elongate, said bending line being substantially orthogonal to the longitudinal axis thereof.

8. An electrical connector according to claim 7, wherein said pairs of teeth on said arm portions extend substantially orthogonal to said bending line transversely across the width of said arm portions, the pairs of teeth in facing relation being offset with respect to each other transversely of said longitudinal axis.

9. An electrical connector according to claim 7, wherein said pairs of teeth on said arm portions extend substantially parallel to said bending line along the length of said arm portions, the pairs of teeth in facing relation being offset longitudinally with respect to each other.

10. An electrical connector for making electrical contact to a conductor comprising:

a bendable member for bending along a bending line, said member including a first arm portion and a second arm portion separated from one another by said bending line; and a first tooth and a second tooth extending outwardly respectively from a surface of said first portion and a surface of said second portion, each tooth being defined by a substantially planar surface and an oblique surface intersecting said planar surface to form a relatively sharp edge at the distal ends of first and second teeth, respectively, said teeth edges being substantially parallel to each other and aligned in offset disposition relative to each other such that in the bent configuration the planar surface of one tooth lies facingly more proximate the oblique surface of the other tooth.

11. An electrical connector according to claim 10, wherein the extent of said offset is about the width of a tooth as measured at the base of said tooth at the surface of said arm portions.

12. An electrical connector according to claim 10, wherein said oblique surface is defined by a curved surface.

13. A cable connector for connection with flat conductor cable of the type having one or more conductors therein and enclosing insulation thereabout, comprising:

an elongate member having first and second spaced apart opposed surfaces being bendable about a transverse bending axis therein, said bending axis dividing said first surface into first and second sections arranged to be positioned in spaced facing relation adjacent opposite surfaces of said flat conductor cable;

a plurality of teeth on a surface of said first and second sections, each tooth defined by a substantially planar sidewall intersecting the bottom wall of a slot separating each pair of teeth, the bottom wall of each said slot extending within and below the surface of said respective sections, each tooth having an oblique surface intersecting said tooth sidewall forming thereby a relatively sharp edge thereat, said sharp edges of said teeth being substantially parallel to each other, the sharp edges of teeth on one section being oriented in offset disposition relative to the sharp edges on the other section such that in the bent configuration a sharp edge of one tooth on each section lies facingly between the edges of a pair of teeth on the other section with one edge of said pair of teeth lying facingly more proximate the oblique surface of such one tooth.

14. A cable connector according to claim 13, wherein the oblique surface of each tooth further intersects a surface portion of said respective sections.

15. A cable connector according to claim 13, wherein said oblique surface is curved.

16. A cable connector according to claim 13, wherein said teeth on said sections extend substantially orthogonal to said bending axis transversely across the width of said sections, the edges of said teeth on said respective sections being offset with respect to each other transversely of said longitudinal axis.

17. A cable connector according to claim 13, wherein said teeth on said sections extend substantially parallel to said bending axis along the length of said sections, the edges of said teeth on said respective sections being offset longitudinally with respect to each other.

* * * * *